US006364671B1

(12) United States Patent
Verneau

(10) Patent No.: US 6,364,671 B1
(45) Date of Patent: Apr. 2, 2002

(54) MULTICONTACT CONNECTOR ELEMENT WITH MEANS FOR CONNECTING ITS CAGE TO GROUND

(75) Inventor: Olivier Verneau, Saint Cyr sur Loire (FR)

(73) Assignee: Radiall, Rosny-Sous-Bois (FR)

( * ) Notice: Subject to any disclaimer, the term of this patent is extended or adjusted under 35 U.S.C. 154(b) by 0 days.

(21) Appl. No.: 09/548,420

(22) Filed: Apr. 13, 2000

(30) Foreign Application Priority Data

Apr. 13, 1999 (FR) ..... 99 04587

(51) Int. Cl.[7] ..... H01R 4/66; H01R 13/648
(52) U.S. Cl. ..... 439/95
(58) Field of Search ..... 439/98, 95, 96, 439/607, 610, 101; 205/122; 378/144

(56) References Cited

U.S. PATENT DOCUMENTS 3,852,700 A * 12/1974 Haws ..... 439/98
4,276,493 A * 6/1981 Srinivasa et al. ..... 378/144
4,405,187 A 9/1983 Muller et al. ..... 439/608
4,426,127 A 1/1984 Kubola ..... 439/609
4,872,091 A 10/1989 Maniwa et al. ..... 361/684
5,240,424 A * 8/1993 Honman et al. ..... 439/95
5,311,408 A * 5/1994 Ferchau et al. ..... 439/98
5,346,403 A * 9/1994 Hyzin ..... 439/95
5,397,242 A 3/1995 Laisne et al. ..... 439/101
5,648,639 A * 7/1997 Hand ..... 439/98
6,142,795 A * 11/2000 Kieniger et al. ..... 439/95
6,149,791 A * 11/2000 Roesener et al. ..... 205/122

FOREIGN PATENT DOCUMENTS

EP 0112648 11/1983

* cited by examiner

*Primary Examiner*—Renee Luebke
*Assistant Examiner*—Felix O. Figueroa
(74) *Attorney, Agent, or Firm*—Schweitzer Cornman Gross & Bondell LLP

(57) ABSTRACT

A multicontact connector element has a metal cage with front and rear faces and one or more cells passing through it from one face to the other. Insulating blocks received in the cells have a plurality of through holes extending from one face of the cage to the other. Individual contacts are received in respective through holes of the insulating block. The multicontact connector element includes a grounding piece that is in electrical contact with the metal cage and that has directly inserted therein the contact portion of a resilient-finger contact, with contact portion being constituted by a ring supporting the radially deformable resilient fingers.

17 Claims, 3 Drawing Sheets

MULTICONTACT CONNECTOR ELEMENT WITH MEANS FOR CONNECTING ITS CAGE TO GROUND

The present invention relates to a multicontact electrical connector element designed to be mounted on a cable and having means for making an electrical connection between certain conductors of the cable and the cage of said connector element.

BACKGROUND OF THE INVENTION

Multicontact connector elements are already known, such as those of the ARINC type data interface which are devices comprising:

- a metal cage, generally made of nickel-plated aluminum, having a front face and a rear face and defining one or more cells passing therethrough from one face to the other;
- one or more insulating blocks received in the cells and each provided with a plurality of through holes extending from one face of the cage to the other; and
- individual contacts received in respective through holes of the insulating block.

Each contact is connected to an individual conductor of a cable by crimping, welding, or soldering at the end of the conductor, and it is inserted into a corresponding hole in which it becomes locked by snap-fastening by means of a retaining clip housed in the hole.

In general, such a connector element does not have means for making electrical connections between the conductors of the cable and the cage, and in particular does not have any means enabling the shielding of the cable to be connected electrically to the ground of the cage, unless a grounding piece is provided between the cable and the cage, which piece needs to be secured to the cage.

In ARINC type connector elements, such a grounding piece is a metal bar protected by a conductive coating and which is pressed against the cage by screwing. The grounding bar has orifices within which resilient-finger contacts are inserted by force, and each of these contacts can receive a contact pin mounted at the end of a ground conductor of a cable.

A resilient-finger contact is an assembly constituted by a contact portion proper, also known as a "thimble", which comprises a ring supporting the resilient fingers which are radially deformable, and by a bushing which completely surrounds the thimble to retain it and protect it, particularly while a contact is being inserted by force. The bushing protects the thimble from any stresses that result from inserting the contact by force so as to ensure that the thimble retains its resilient characteristics, in order to enable it to perform its function in reliable manner.

The drawback of such resilient-finger contacts is that while they are being inserted by force into the orifices of the grounding bar, they necessarily damage the coated surface of the grounding bar.

Although such damage is of little consequence under normal conditions of use, it constitutes a real problem when the conductor element is to operate under harsh conditions, in particular in surroundings that are very damp and very salty, since under such circumstances the grounding bar is quickly corroded around the orifices receiving the resilient-finger contacts.

Indeed, such corrosion is accelerated if, as is often the cage, the bar is made of nickel-plated aluminum, and the phenomenon becomes more marked if the resilient-finger contacts are gold plated.

OBJECTS AND SUMMARY OF THE INVENTION

The present invention seeks to provide a novel solution enabling the shielding of the cable to be connected to the ground of the cage.

The present invention provides a multicontact electrical connector element comprising:

- a metal cage having a front face and a rear face and defining one or more cells passing therethrough from one face to the other;
- one or more insulating blocks received in the cells and each provided with a plurality of through holes extending from one face of the cage to the other;
- individual contacts each received in a through hole of the insulating block; and
- a grounding piece in electrical contact with the metal cage;

the connector element including the contact portion of a resilient-finger contact inserted directly in the grounding piece, said contact portion being constituted by a ring supporting the radially deformable resilient fingers.

In other words, the invention provides for the contact portion of a resilient-finger contact to be inserted directly in the grounding piece without its protective bushing.

According to the invention, it is advantageous for the grounding piece that is in contact with the cage to be made of bronze.

In addition, the grounding piece can have a thin layer of nickel deposited by electroplating.

Such a layer of nickel performs its conventional function of providing protection against corrosion and presents the additional advantage of being ductile, thereby preventing it from being damaged during insertion of the resilient-finger contact portions, and guarantees better resistance to corrosion over time, even under extremely damp conditions.

Furthermore, if the grounding piece is made of bronze, any local damage to its plating will not give rise to the consequences described above since the copper-nickel electrochemical couple presents low oxidation-reduction potential.

In a particular embodiment of the invention, the grounding piece in contact with the cage is constituted by the cage itself, which cage is provided with orifices for receiving the resilient-finger contact portions.

In another embodiment of the invention, the grounding piece in electrical contact with the cage is a grounding bar provided with orifices receiving the resilient-finger contact portion.

In another embodiment, the cage has a peripheral collar and the grounding piece forms a frame which surrounds the cage and which bears against its peripheral collar.

In another embodiment of the invention, a grounding plate pierced by orifices receives the resilient-finger contact portions and thus acts as the grounding piece. This grounding plate is pressed against the collar of the cage and is thus electrically connected thereto.

In all cases, a second grounding piece which may be in the form of a bar, a frame, or a plate, and which may be conductive or otherwise, covers the grounding piece to hold the retaining clips which serve to snap-fasten the contact pins inserted in the resilient-finger contact portions.

In a particular embodiment, each orifice formed in the grounding piece to receive a resilient-finger contact portion is surrounded by at least one recess which leaves the equivalent of a cylinder of material between said orifice and the recess(es), thereby reconstituting the protective bushing missing from the resilient-finger contact.

This recess can be constituted by a cylindrical groove formed in the surface of the grounding piece providing it is sufficiently thick, or by holes passing through the entire thickness of said grounding piece and separated by bridges of material.

BRIEF DESCRIPTION OF THE DRAWINGS

In order to make the invention better understood, there follows a description of embodiments given as examples that do not limit the scope of the invention and that are described with reference to the accompanying drawings, in which.

MORE DETAILED DESCRIPTION

Figure 1:
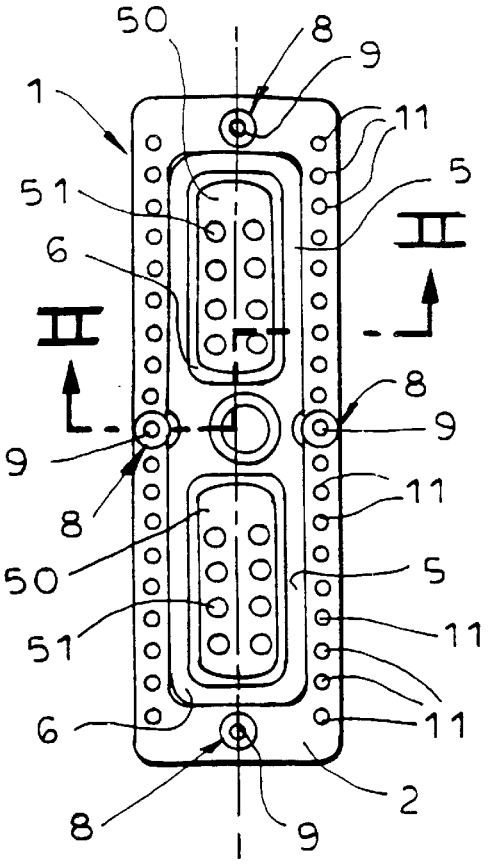
FIG. 1 is a plan view of the cage of a multicontact connector element.
Figure 2:
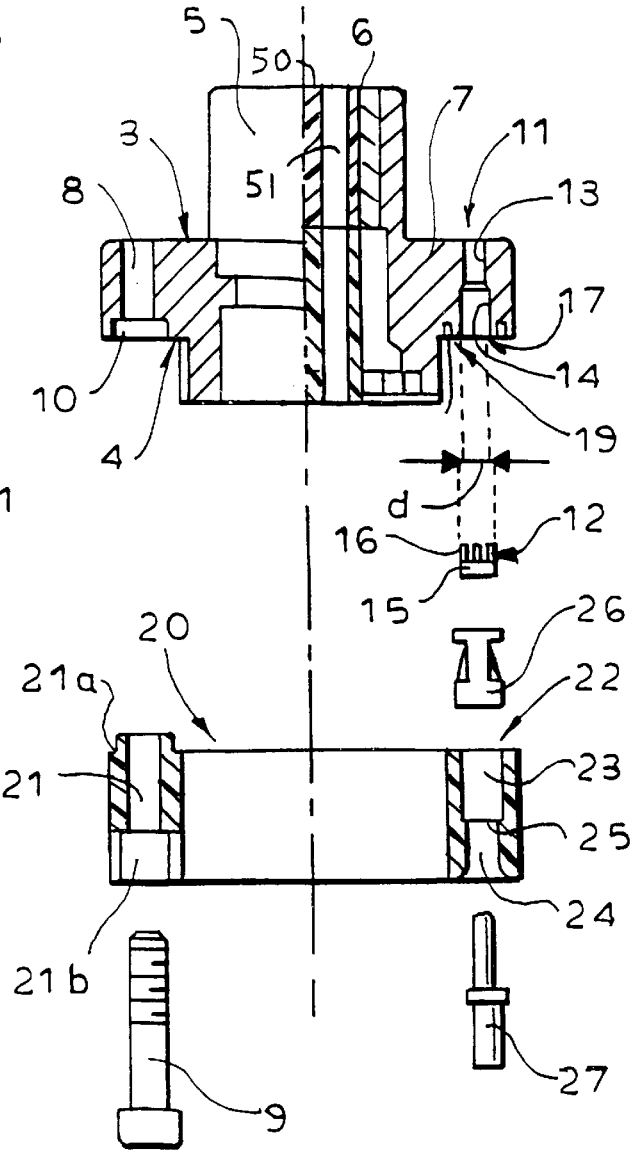
FIG. 2 is a an exploded section view along on II—II in FIG. 1 and on a larger scale, together with a resilient-finger contact portion, a retaining clip, an insulating frame, and a screw that have been added thereto.
Figure 3:
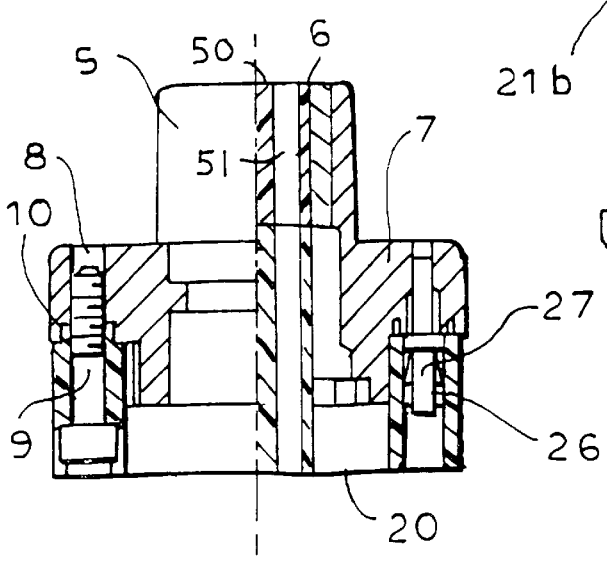
FIG. 3 is a view analogous to FIG. 2 showing the various parts assembled together.

The connector cage 1 shown in FIGS. 1 to 3 is constituted by a bronze slab 2 having a front face 3 and a rear face 4.

Projecting from its front face 3, the slab 2 has two sleeves 5 of substantially rectangular section, each forming a through passage 6 made in the slab.

Each through passage 6 together with the corresponding sleeve 5 defines a cell for receiving an insulating block (not shown) carrying a plurality of contacts, themselves received in through orifices in the insulating block.

Via the rear face 4 of the slab 2, the contacts are connected to individual cable conductors (not shown). Via the front face 3 of the slab 2, the contacts are designed to couple with complementary contacts of another connector element (not shown).

The section views of FIGS. 2 and 3 show that the slab forms a collar 7 around the sleeves 5.

In the middles of its four sides, this collar 7 has through passages 8 for receiving screws 9 with respective setbacks 10 in the rear face 4 of the slab.

In addition, along its two long sides, the slab is pierced by a plurality of through passages 11 of smaller diameter, these passages 11 being designed to receive resilient-finger contact portions 12.

Each passage 11 has a front portion 13 and a rear portion 14 of diameter d.

The diameter d is slightly smaller than the outside diameter of the widest portion of the resilient-finger contact portion 12, i.e. level with its base ring 15 from which there project six fingers 16 that are suitable for deforming outwards in elastic manner.

Around the mouth 17 of the passage in the rear face 14, the slab 2 has a cylindrical groove 18 of depth substantially equal to the height of the base ring 15 of the contact portion 12.

Between the groove 18 and the through passage 11, there remains a thin-walled cylinder of bronze 19 which is suitable for deforming during forced insertion of the contact portion so as to limit the mechanical stresses applied to the ring 15 in order to ensure that the resilient fingers 16 retain their initial operating characteristics.

Thus, the resilient-finger contact portion 12 can operate properly after it has been inserted into the cage of the connector element.

In addition, the ability of the cage to deform prevents the cage from being subjected to excessive damage due to the insertion by force, thereby specifically saving its plating from damage.

An insulating frame 20 of substantially the same surface dimensions as the collar 7 is placed on the rear face 4 of the collar.

In the middle of each of its four sides, the insulating frame 20 has an orifice 21 that is in register with a corresponding orifice 8 for receiving the screws 9 when the insulating frame is in place, as can be seen in FIG. 3.

On its front face, each screw passage 21 has a cylindrical projection 21*a* which is received in the setback 10 of the collar, thereby ensuring that it is centered relative to said collar. A setback 21*b* is also provided in each of these screw passages to receive the head of the corresponding screw 9.

In register with the passages 11 provided through the collar for receiving the contact portions 12, the insulating frame 20 also has through passages 22 each having a front section 23 and a rear section 24 that is of smaller diameter than the front section, such that between the sections there is a shoulder 25 which serves as an abutment for a retaining clip 26 inserted in said passage via its front face.

As can be seen in FIG. 3, once the insulating frame 20 is in place on the cage 1, the retaining clip 26 bears against the rear face 4 of the slab 2. The retaining clip 26 and the contact portion 12 are in alignment with each other.

FIGS. 2 and 3 also show a contact pin 27 which is crimped to the end of a ground conductor of a cable (not shown). It can be seen that the pin 27 penetrates into the contact portion 12 via the insulating frame 20 and is retained in this position by the snap-fastening performed by the retention clip 26.

The cage is thus grounded without the cage being subjected to damage, such that it can withstand very damp conditions without corroding.

Figure 4:
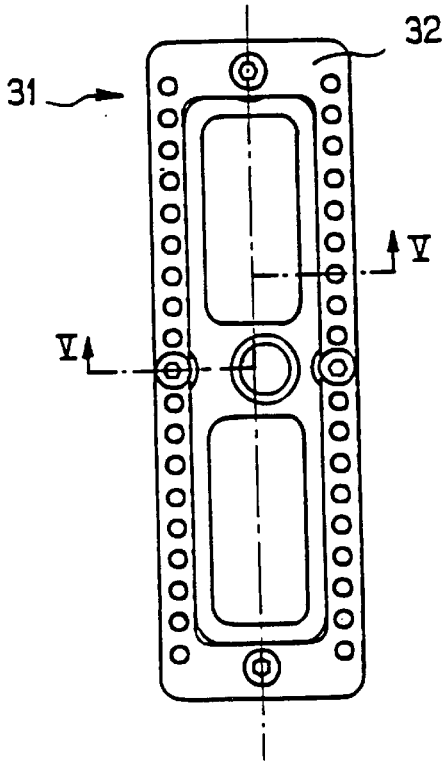
FIG. 4 is a plan view of the cage of another multicontact connector element.
Figure 5:
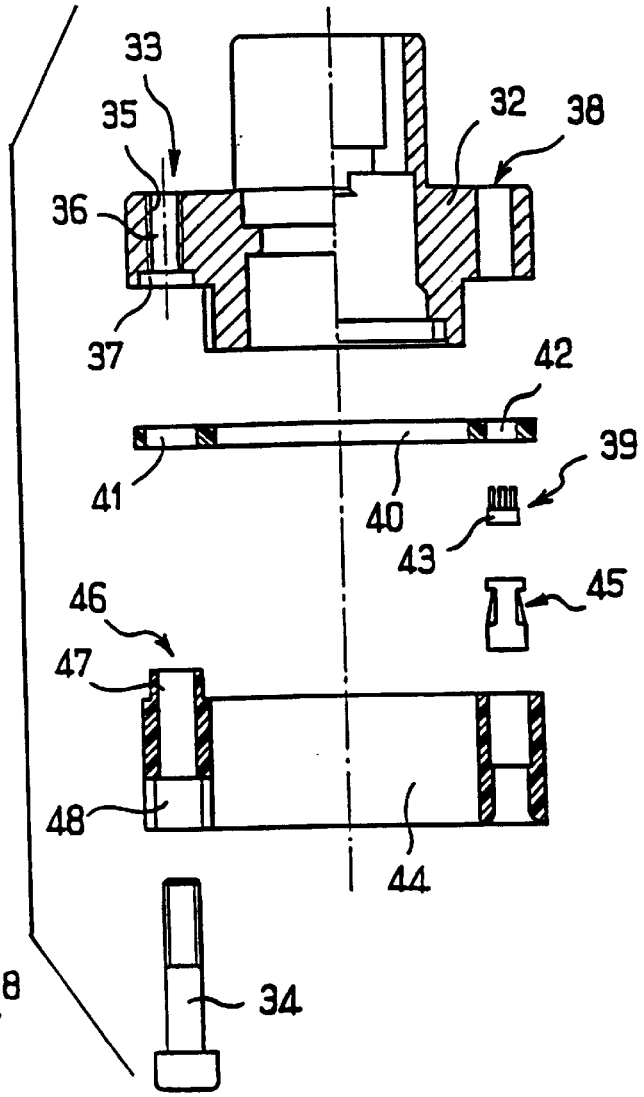
FIG. 5 is a section view on V—V in FIG. 4 and on a larger scale, together with a grounding plate, a resilient-finger contact portion, a retaining clip, an insulating frame, and a screw that have been added thereto.
Figure 6:
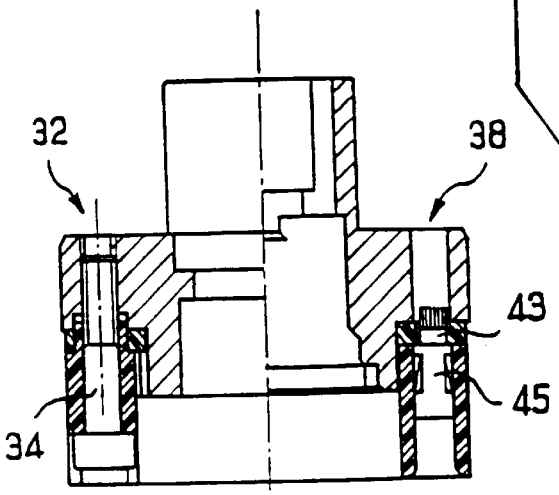
FIG. 6 is a view analogous to FIG. 4 showing the various parts assembled together.

In the embodiment of FIGS. 4 to 6, the cage 31 is of substantially the same shape as the cage described above.

For the present invention, the essential differences concerning the cage lie in the collar-forming slab 32 which is thinner and which has through passages in identical positions but that are slightly different.

The passages 33 for the screws 34 are tapped 35 in their front portions 36 extending over nearly the entire thickness of the slab 32, and they have a setback 37 at their rear openings.

The passage 38 for the contacts 39 are simple cylindrical orifices corresponding to the front portions 13 of the passages 11 in the embodiment of FIGS. 1 to 3.

In this embodiment, a metal plate 40 is pressed against the rear face of the collar 32.

This metal plate 40 is made of bronze that has been nickel-plated electrolytically.

Holes 41 and 42 are formed through this metal plate in register with each of the through passages in the collar.

The four holes 41 in register with the passages 33 for the screws 34 extend the setbacks 37.

The holes 42 in register with the passages 38 for the contacts 39 correspond to the rear portions 14 of the contact passages 11 in the embodiment of FIGS. 1 to 3. In other words, the contact portions 39 are inserted into the metal plate, the ring 43 of each contact portion being inserted by force in the thickness of the plate 40.

The electroplated layer of nickel on the metal plate, or grounding plate, presents ductility that enables it to accommodate deformation while the ring is being inserted by force.

Security against corrosion is increased by the fact that even if a crack should occur through the layer of nickel during insertion, the bronze constituting the plate presents a low risk of electrolytic coupling with nickel.

Figure 7:
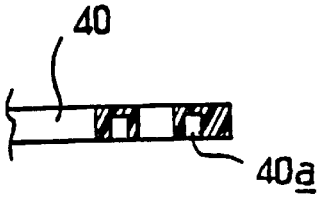
FIG. 7 is a fragmentary section view of a variant of the FIG. 5 plate.

Nevertheless, to facilitate deformation of the metal plate 40 during insertion of the contact portion 39, it is possible to provide a recess in the form of a groove 40*a* around each orifice 42, as shown in FIG. 7.

As in the embodiment of FIGS. 1 to 3, an insulating frame 44 covers the assembly so as to hold the retention clips 45 in line with the resilient-finger contact portions 39.

Each screw passage 46 in the insulating frame 44 has a cylindrical projection 47 on its front face which can be received in the orifice 41 of the grounding plate 40 and in the setback 37 of the collar, thereby centering the grounding plate relative to the collar. A setback 48 is also provided in each of these screw passages to receive the head of the corresponding screw 34.

In this embodiment, as in the preceding embodiment, grounding of the cage is reliable and durable.

Figure 8:
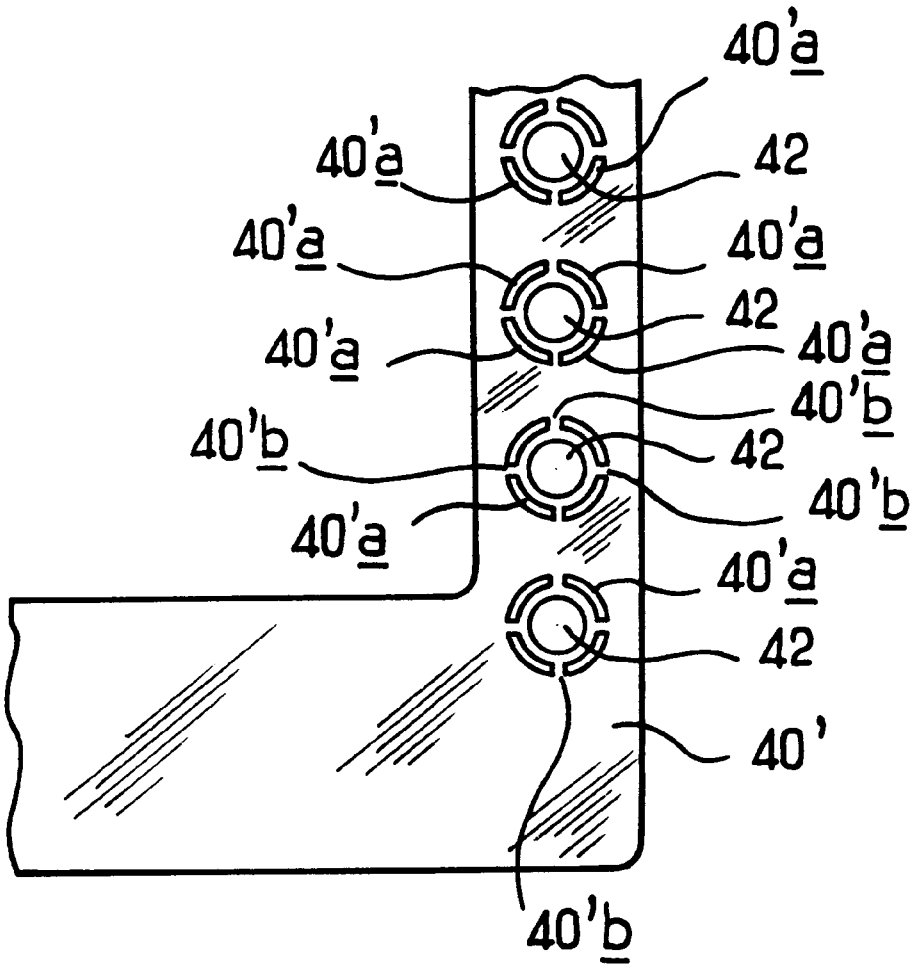
FIG. 8 is a fragmentary front view on a larger scale of another variant of the FIG. 5 plate.

FIG. 8 shows another variant of the grounding plate 40' in which each orifice 42 is surrounded by a recess made up of four through holes 40'*a* each in the form of a portion of a ring, these portions being separated in pairs by bridges of material 40'*b* which unite the cylindrical wall of the orifices with the remainder of the plate. The plate 40' thus presents capacity for deformation around each of its orifices 42 that is sufficient to enable it to receive the contact portions 39 while retaining their initial operating characteristics.

Naturally, the embodiments described above are not limiting in any way and may be modified in any desirable manner without thereby going beyond the ambit of the invention.

What is claimed is:

1. A multicontact connector element comprising:

a metal cage having a front face and a rear face and defining one or more cells passing through the metal cage from one face to the other, said metal cage having a plurality of orifices each receiving a contact pin of a ground conductor;

one or more insulating blocks received in the cells and each provided with a plurality of through holes extending from one face of the cage to the other; and individual contacts, each received in a respective through hole of the insulating block;

the connector element including a grounding piece that is in electrical contact with the metal cage and that has directly inserted therein a contact portion of a resilient-finger contact, said contact portion being constituted by a ring supporting the radially deformable resilient fingers.

2. A connector element according to claim 1, wherein the grounding piece that is in contact with the cage is made of bronze.

3. A connector element according to claim 2, wherein the grounding piece has a thin layer of nickel deposited thereon by electroplating.

4. A connector element according to claim 1, wherein the grounding piece in electrical contact with the cage is a grounding bar provided with orifices receiving the contact portions.

5. A connector element according to claim 4, wherein each orifice formed in the grounding piece to receive a resilient-finger contact portion is surrounded by at least one recess leaving a substantially cylindrically-shaped portion of material between said orifice and the recess(es), forming a protective bushing around the resilient-finger contact.

6. A connector element according to claim 5, wherein the recess consists in a cylindrical groove formed in the surface of the grounding piece.

7. A connector element according to claim 5, wherein the recess consists in through holes passing through an entire thickness of the grounding piece and separated from one another by bridges of material.

8. A connector element according to claim 1, wherein the cage has a peripheral collar and wherein the grounding piece is a grounding plate pierced with orifices for receiving the resilient-finger contact portions and bearing against the collar of the cage.

9. A connector element according to claim 1, including a conductive second piece on the grounding piece for retaining contact pins inserted in the resilient-finger contact portions.

10. A multicontact connector element comprising:

a metal cage having a front face and a rear face and defining one or more cells passing through the metal cage from one face to the other;

one or more insulating blocks received in the cells and each provided with a plurality of through holes extending form one face of the cage to the other;

individual contacts each received in a respective through hole of the insulating block;

said metal cage defining a grounding piece for the connector element, said metal cage having a plurality of orifices each receiving a contact portion of a resilient-finger contact, said contact portion being constituted by a ring supporting radially deformable resilient fingers, and said plurality of orifices each receiving a contact pin of a ground conductor.

11. A connector element according to claim 10, wherein the grounding piece that is in contact with the cage is made of bronze.

12. A connector element according to claim 11, wherein the grounding piece has a thin layer of nickel deposited thereon by electroplating.

13. A connector element according to claim 10, including a second piece on the grounding piece for retaining contact pins inserted in the resilient-finger contact portions.

14. A connector element according to claim 10, wherein each orifice formed in the grounding piece to receive a resilient-finger contact portion is surrounded by at least one recess forming at least a partial cylinder of material between said orifice and the recess(es), thereby forming a protective bushing around the resilient-finger contact.

15. A connector element according to claim 14, wherein the recess consists of a cylindrical groove formed in the surface of the grounding piece.

16. A connector element according to claim 14, wherein the recess consists in through holes passing through the entire thickness of the grounding piece and separated from one another by bridges of material.

17. A connector element according to claim 10, wherein the metal cage has a peripheral collar through which the orifices are made.

* * * * *